US008104768B2

(12) United States Patent
Al-Buijan

(10) Patent No.: US 8,104,768 B2
(45) Date of Patent: Jan. 31, 2012

(54) BOARD GAME

(76) Inventor: Meshari A. Al-Buijan, Qortuba (KW)

( * ) Notice: Subject to any disclaimer, the term of this patent is extended or adjusted under 35 U.S.C. 154(b) by 0 days.

(21) Appl. No.: 12/748,701

(22) Filed: Mar. 29, 2010

(65) Prior Publication Data

US 2011/0233865 A1 Sep. 29, 2011

(51) Int. Cl.
*A63F 3/00* (2006.01)

(52) U.S. Cl. ..... 273/242; 273/258

(58) Field of Classification Search ..... 273/242, 273/249, 250, 251, 258
See application file for complete search history.

(56) References Cited

U.S. PATENT DOCUMENTS 1,362,218 A * 12/1920 Beloin ..... 273/249
1,406,484 A * 2/1922 Paris ..... 273/249
1,553,611 A * 9/1925 Harrison ..... 273/249
3,650,534 A * 3/1972 Collett ..... 273/239
4,932,667 A * 6/1990 Gorski et al. ..... 273/249
5,120,066 A * 6/1992 Cohen ..... 273/258
5,273,431 A 12/1993 Charouhas
5,544,891 A 8/1996 Gibson et al.
5,692,753 A * 12/1997 Falk ..... 273/248
6,279,909 B1 * 8/2001 Alexander et al. ..... 273/249
6,402,145 B1 6/2002 Iglesias
6,547,245 B1 4/2003 Olutunfese
6,974,131 B2 12/2005 Frank
7,461,844 B1 12/2008 DeVor
7,549,640 B1 * 6/2009 Evans et al. ..... 273/243
2002/0066999 A1 * 6/2002 Rossi ..... 273/243

* cited by examiner

*Primary Examiner* — Vishu K. Mendiratta
(74) *Attorney, Agent, or Firm* — Lowe Hauptman Ham & Berner LLP

(57) ABSTRACT

A board game includes a multi-color game board including eight distinguishing colors on a white background. The game also includes eight game pieces of eight colors that match the color spaces on eight radially extending arms surrounding a central hub. Each of the radially extending arms includes eight outwardly directed colored spaces and eight inwardly directed spaces abutting the eight outwardly directed spaces. The inwardly and outwardly directed spaces adjacent to the central hub and a turnaround space at the end of that arm are of the same color while the spaces in between the adjacent spaces and the turnaround spaces are of different colors.

3 Claims, 3 Drawing Sheets

BOARD GAME

FIELD OF THE INVENTION

This invention relates to a board game of the type having a game board with a plurality of radially extending arms disposed about a central or inner hub and a plurality of game pieces to move along a plurality of multi-colored spaces according to a throw of the dice and more particularly to a board game that incorporates a number of question and answer cards and a timer for allowing a player a limited time to answer a question.

BACKGROUND FOR THE INVENTION

Board games that include a game board and a plurality of game pieces with one piece for each player are well known and have been in use for over 50 years. In fact there is a constant source of new games based on a variety of formats. In many such games, the games include question and answer cards and/or opportunities to draw a card with further instructions on the card. For example, a question and answer board game is disclosed in a Igliseas, U.S. Pat. No. 6,402,145. As disclosed, a question and answer board game to be played by at least two players having a board, a frame congregating a plurality of cells, dice, a plurality of cards having written questions and instructions to the players and a plurality of tokens having different colors to identify the users, and is designed to identify the current position of the players at one of the cells. A number of cells represent websites designed to provide instructions to the player, the rest of the cells represent websites designed to companies that advertise their service and products; a user has to respond correctly to a predetermined number of questions in order to possess the selected cell. The purpose of this game is to possess a higher number of cells or websites and cards with correct answers about the history and development of the internet industry.

Educational games have also become popular. For example, a Olutunfese, U.S. Pat. No. 6,547,245 discloses an educational game for teaching verses from the bible in an entertaining manner. The educational game includes a game board, a game path is on the game board, the game path is divided into a plurality of game spaces that begins with a starting space and ends with an ending space. Bible indicia are in a plurality of the game spaces, each of the Bible indicia comprises a name of a book contained in the Christian Bible. A plurality of scripture cards, each of which has questions indicia thereon, corresponds to each of the Bible indicia. A chance means determines movement about the game path. A plurality of game tokens is used for moving about the game path. The players choose a scripture card if they land on a game space having Bible indicia thereon and they recite a verse referred to by the question indicia on the scripture card. The game is won by being the first player to move their token to the finish space.

A further approach to board games is disclosed in a Frank, U.S. Pat. No. 6,974,131. As disclosed therein a board game which combines traditional board game elements with an unrelated activity, as for example that of preparing a meal. The board has three paths of serially arranged spaces along which a player's tokens travel. A chance device determines the number of spaces moved. Upon alighting on any particular space, a card is drawn, which card is color coordinated to the space just occupied. The card specifies an interactivity such as a question to be answered or a musical theme to be tapped, hummed or whistled. The player must interactively respond. Upon completion of the first path, players select on a first to arrive basis a task associated with meal preparation, serving and clean up. An example is mixing and serving of a beverage or cooking the entrée. One option is to be relieved of any task. Upon completion of the path by their token each player receives an instructional card advising details of the associated task. The game is played in three phases, each utilizing one path and corresponding to three phases of a meal, such as an appetizer, entrée, and desert. Optionally, invitations to a combined meal and game are sent prior to the event by postcard.

A still further example of a board game is disclosed in a DeVor, U.S. Pat. No. 7,461,844 entitled "You Ought to Remember Board Game". The DeVor patent discloses a trivia board game in which each player attempts to answer trivia questions in order to advance on the board. Each player retains his or her game piece by designating their year of birth which translates over to the Chinese Zodiac Animal involving the rat, ox, tiger, rabbit, dragon, snake, horse, ram, monkey, rooster, dog and pig. The first player rolls both dice while the player to the right picks up a card announces the year and reads the question from the corresponding color category designated on the dice. The person being asked the question has two minutes to respond correctly in order to advance. Once the time runs out the players reading the question yells "all play" which enables all of the players, excluding the reading player, from answering the question and advancing on the game board. If a player lands on a "You Ought to Remember" space he or she must respond to a trivia question from "You Ought to Remember" card designated by rolling the number dice. The game progresses to all the players in the same fashion until a player reaches the end of the game board at which point he or she has won the game.

Notwithstanding the above, it is presently believed that there is a need and a potential commercial market for a new, exciting, challenging and educational board game in accordance with the present invention. There should be a market for such games because they provide a challenge, are adaptable for different age groups and fun for use by relatively young children to adults. Further, it is believed that the colorful display provides challenges in different fields ranging from mathematics to history and current affairs. It is also believed that such games can be manufactured and sold at a competitive cost and are readily upgradeable to provide new challenges or to overcome any competitive advantage from familiarity with the game.

BRIEF SUMMARY OF THE INVENTION

In essence, a board game in accordance with the present invention comprises or consists of a combination of a game board having a plurality of radially extending arms disposed about a central hub and whereas each of the radially extending arms include a plurality of multicolored sequential spaces disposed on each side of the arm in two directions with one of the directions leading outwardly from the central hub and the other leading inwardly toward the central hub and a turn-around space at the end of each arm. In addition, the game board includes a transfer space connecting adjacent arms at the central hub.

The board game also includes a plurality of game pieces with each of the game pieces a different color than the other of the game pieces, two dice, a quantity of play money and several decks of question and answer cards wherein each of the decks have backs of a distinct color. A timer is provided and whenever a player takes a turn by roiling the dice and moving his game piece the number of spaces indicated by the dice, the player is then given a question from a card from a deck with the same color on the back of the card as the color on the space where the individual has landed. The individual then has 30 seconds to give the correct answer and if the answer is correct a reward from each player is paid to the individual, but if the answer is incorrect, the individual pays a fine to the other player with the same color on their game piece as the color card from which the question is selected. The last player to run out of money is the winner.

The invention will now be described in connection with the accompanying drawings wherein like reference numerals have been used to indicate like parts.

DESCRIPTION OF THE PREFERRED EMBODIMENTS OF THE INVENTION

Figure 1:
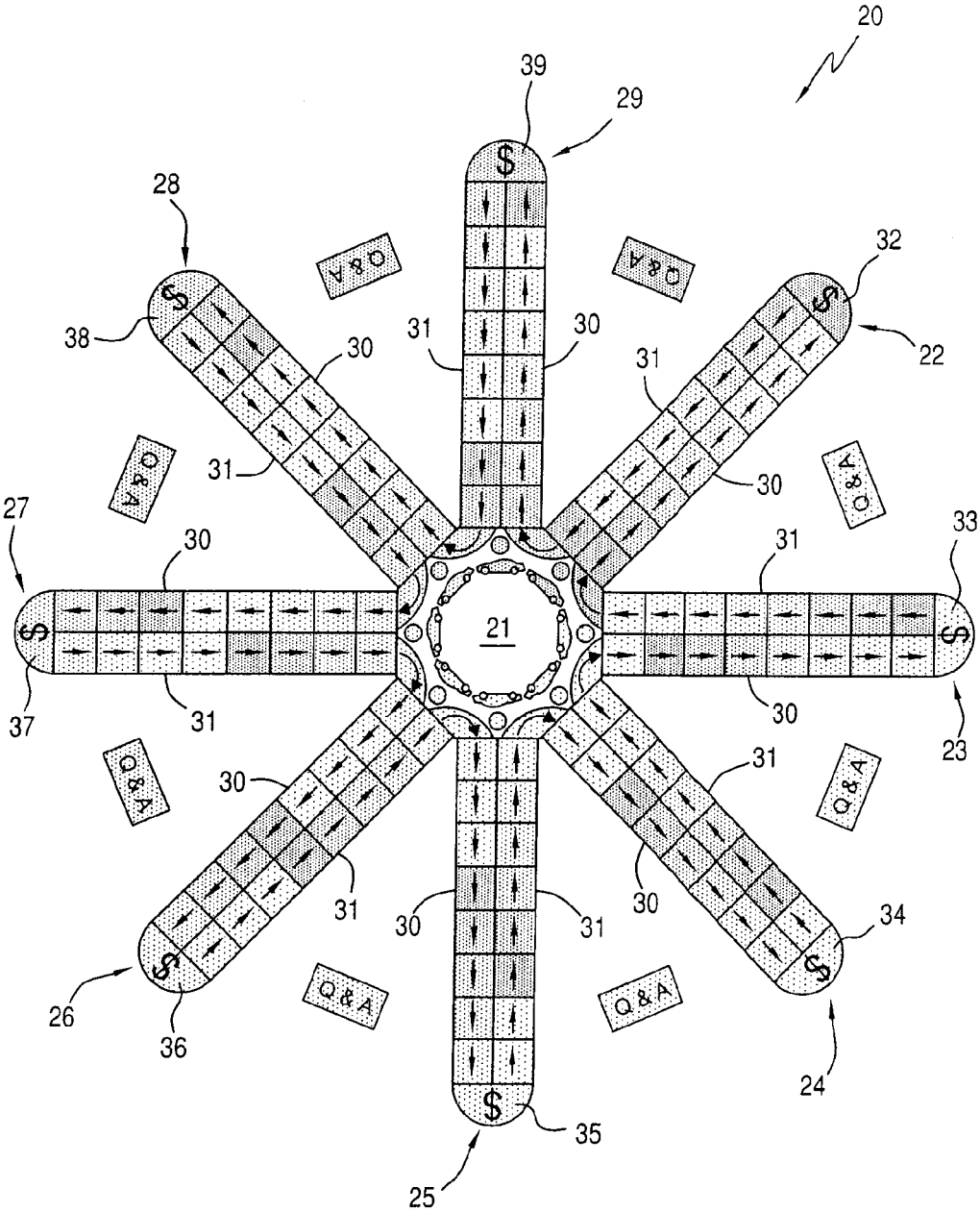
FIG. 1 is a top or plan view of a game board and game pieces for players in accordance with a preferred embodiment of the invention.

As illustrated in FIG. 1, a game board 20 of eight distinct colors on a white background includes a central hub 21 and eight radially extending arms 22-29 inclusive disposed around the central hub 21. Each of the radially extending arms 22-29 includes an outer end portion, a leading edge 30, a closed end portion and a trailing edge 31. The leading edge 30 includes indications of an outward direction such as a small arrow on each space while the trailing edge spaces include arrows pointing inwardly toward the central hub 21.

Each of the arms 22-29 include eight colored spaces on a leading edge 30 and eight colored spaces on a trailing edge 31 plus a turnaround space 32 on arm 22 a turnaround space 33 on arm 23, 34 on 24, 35 on arm 25, 36 on arm 26, 37 on arm 27, 38 on arm 28, and 39 on arm 29. The color of the turnaround spaces 32-39 match the start and finish spaces, for example on the arm 22 the start and finish spaces are blue as is the turnaround space 32. The outwardly directed eight spaces in an outer direction then proceeds from blue to red to pink to brown, to green to gray to yellow and orange while the inwardly directed spaces between the outer turnaround space on arm 22 start with red and proceed to pink, brown, green, gray, yellow and orange while the inwardly directed spaces proceed with red, pink, brown, green, gray, yellow, orange and end with blue. For contrast, the inner or start space in arm 23 are orange as is the turnaround space 33. Thus, the additional outwardly directed spaces are blue, red, pink, brown, green, gray and yellow while the inwardly directed spaces are blue, red, pink, brown, green, gray, yellow and orange in that direction. In arm 24 the colors adjacent to central hub are yellow as is the turnaround space while the spaces on the leading edge proceed from yellow to orange, blue, red, pink, brown, green, gray and end with yellow.

On the arm 25, the spaces adjacent to central hub 21 are gray as is the turnaround space 35. The outwardly directed spaces are yellow, orange, blue, red, pink, brown, and green while the inwardly directed spaces are yellow, orange, blue, red, pink, brown, green and gray. Then in arm 26 the colors adjacent to the hub 21 are green and the outwardly extending green space includes a green transfer portion that extends into the first outwardly directing space in the adjacent arm. The outwardly directing space proceeds with gray, yellow, orange, blue, red, pink and brown with a green turnaround space 36 and inwardly directed spaces in gray, yellow, orange, blue, red, pink, brown and green. The arm 27 has a brown start space adjacent to central hub 21 and brown turnaround space 37 with green, gray, yellow, orange, blue, red and pink outwardly directed spaces and green inwardly directed space together with gray, yellow, orange, blue, red, pink and brown space on the trailing edge 31.

The arm 28 includes two pink spaces adjacent to the central hub and a pink turnaround space 38. The outwardly spaces after the pink start space includes brown, green, gray, yellow, orange, blue and red in that direction while the inwardly directed spaces are brown, green, gray, yellow, orange, blue, red and pink. Finally, the arm 29 includes two red spaces adjacent to the central hub and an outer turnaround space 39 that is also red. The outer directed spaces between the red space adjacent to central hub and the red outer turnaround space 39 are pink, brown, green, gray, yellow, orange and blue in that order while the inner directed spaces are pink, brown, green, gray, yellow, orange, and blue in that order.

Figure 2:
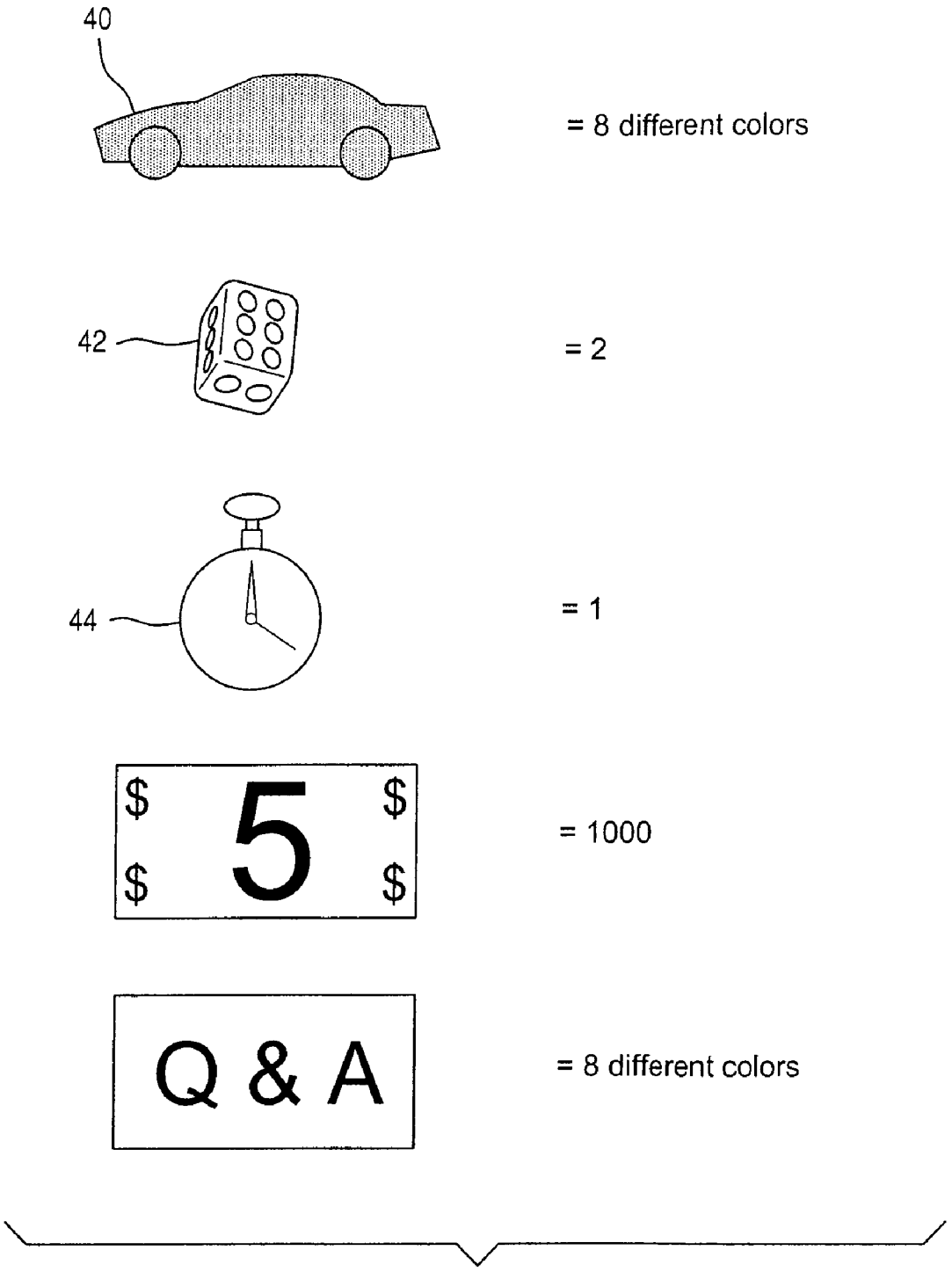
FIG. 2 is a schematic illustration of a set of elements as used in the game in accordance with the present invention.

As shown in FIG. 2, the board game 20 also includes eight game pieces 40 of different colors that match the colors on the aforementioned spaces. A pair of dice 42 and timer 44 is also provided for use in playing the board game 20. In addition, the board game includes a supply of toy money in five dollar bills or some other pre-selected denomination. Finally, the board game 20 includes eight decks of fifty questions and answer cards with each of the decks having the backs of all of the cards in that deck in a distinct color that matches one of the colors of the game pieces and spaces. As shown in FIG. 1 the game board 20 also includes eight symbols; one symbol for each deck of cards. The symbols are printed in the same eight colors as the back of the questions and answer cards. In the preferred embodiment of the invention, the eight backs of cards include questions and answers from the following categories: mathematics, history, geography, political science, current events, sports and the arts.

Figure 3:
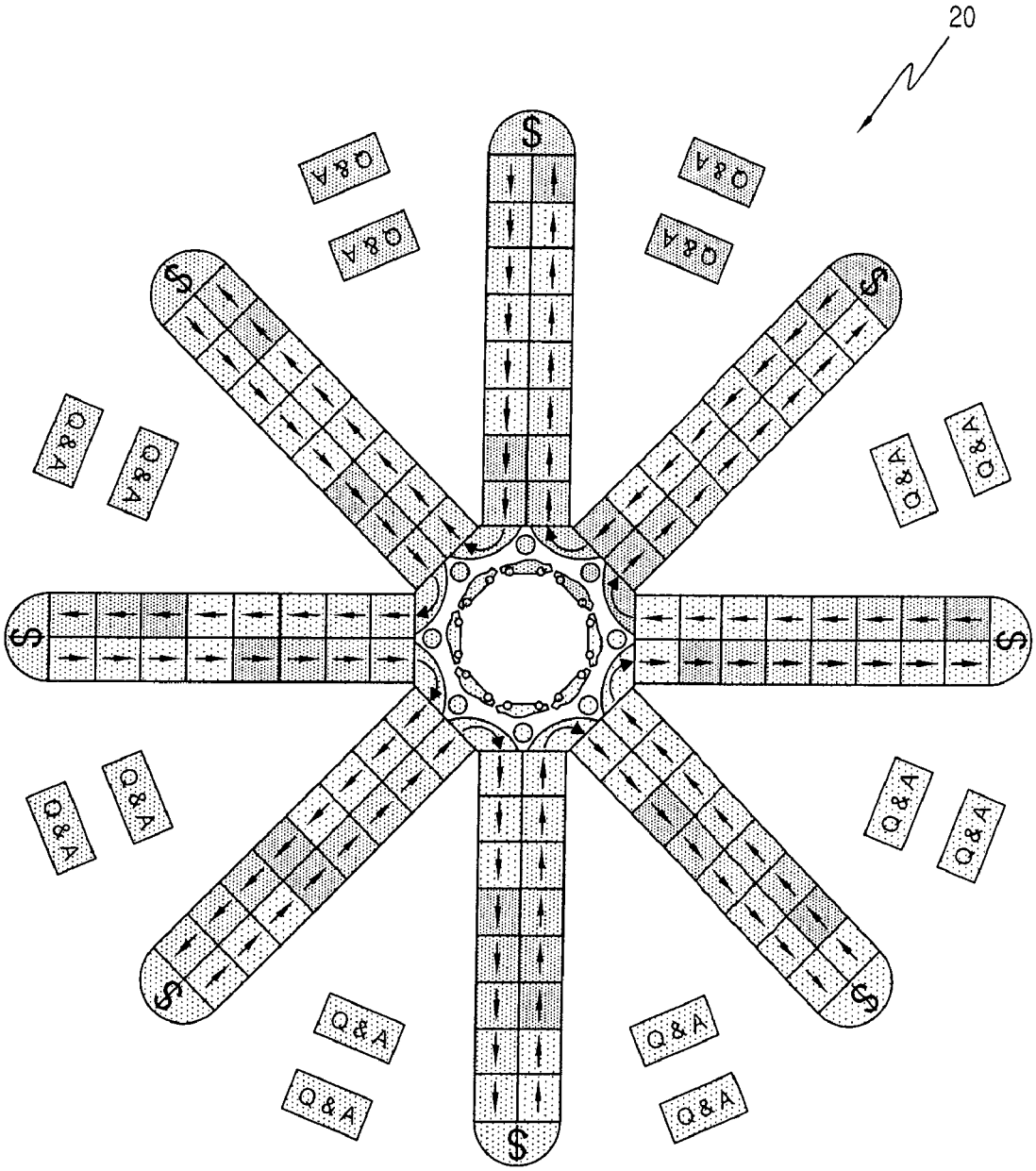
FIG. 3 is a top or plan view of a board game for use in playing a game in accordance with a second embodiment of the invention.

A second embodiment of the invention is illustrated in FIG. 3. As shown, the board game 20 is almost identical to FIG. 1, but includes an additional eight symbols for receiving a second set of eight decks of questions and answer cards. Those symbols are outwardly of said first eight decks that are located toward the outer edge of adjacent arms. The second set of eight decks preferably has the same colors as the first eight decks but of a different design. The second set includes questions and answers for a different age group than the first set.

It is also contemplated that both sets of cards can be used in a single game when players of different age groups are playing allowing the player in the younger age group to receive questions from those cards on an inner set of cards and those of an older group receive questions from those in an outer ring. It is also contemplated that players of a plurality of age groups can use a plurality of card decks.

Finally, it is also contemplated that the owner of a board game in accordance with the present invention can order additional card decks with new questions and answers in order to avoid learned answers by previous players.

Rules of the Game

1.) No. of Players: 2 and more.
2.) Fifty cards are selected from each group randomly. Then put them in their particular places on the playing board.
3.) Each player (or team) defines his particular color before playing is initiated, then his particular playing tool is placed on the starting point with the particular color.
4.) Each player (or team) throws the dice to determine the beginner. The playing begins with the player who gets the lowest figure.
5.) Each player gets an amount of 50 dollars before commencement of playing.

6.) The players move according to the total on the dice. The players answer the question of a player with the color on which they stop station during thirty seconds. If the player answers the question correctly. The other players pays to him 5 dollars bonus. The answered question is removed. If the player could not answer the question addressed to him by the other player, he pays a fine of 10 dollars to the player with the same color as the station where he stopped. In case he has no money, he should sell two cards to pay the fine.

7.) Each player who stops in the cell ($) during playing gets the chance of winning 20 dollars promptly if he gets a double upon throwing the dice in three consequent trials only (1, 1, 2, 2, 3, 3, etc.

8.) The player is out of playing if his particular cards are finished in addition to the monies and so on until the first winner is defined.

9.) Each player can buy new question cards, 5 dollars for each card during the suspension of playing at his station. But if he wants to buy question cards and if he is not stopping in his station, he should pay 10 dollars for each question.

10.) The players can play as a team according to their wish at the beginning of playing for participation by more people.

While the invention has been described in accordance with its preferred embodiments it should be recognized that changes and modifications may be made therein without departing from the scope of the appended claims.

What is claimed is:

1. A board game comprising the combination of:

a game board having eight radially extending arms disposed about a central hub and wherein each of said radially extending arms include eight multi-colored sequential spaces disposed on each of said arms in two directions with one of said directions leading outwardly from said central hub and the other multi-colored sequential spaces leading inwardly toward said central hub;

wherein each arm includes eight spaces in each of two directions and each arm including spaces in eight colors in each direction in which the colored spaces on each pair of spaces adjacent said central hub are of said eight colors so that said eight arms each have a pair of spaces of one of said colors adjacent said central hub that is distinguished from each of the other arms;

a turn around space at the outer end of each arm and a transfer space connecting two adjacent arms at said central hub;

in which the leading edge of each of said arms assuming a clockwise rotation includes an outwardly directed arrow for the spaces on that edge and an inwardly directed arrow for which the direction of movement of a game piece on the other side of said arm;

in which the space of an outer end of each of said arms defines a semi-circle that covers one of said outer direction spaces and one of said inner directed spaces and has a color that matches the color of said two adjacent spaces to said inner hub;

eight game pieces with each of said game piece a different color than the other of said game pieces;

two dice;

a quantity of play money;

eight decks of question and answer cards, one deck for each of said eight colors and wherein one deck includes questions and answers from one of eight categories; wherein eight categories include mathematics, history, geography, political science, current events, sports and the arts;

a timer and wherein each player takes a turn by rolling the dice and moves his/her game piece the number of spaces indicated on the dice and then is given a question from a card from a deck with the same color on the back of the card as the color of the space where the individual has landed, and the individual then has 30 seconds to give the correct answer, if the answer is correct the individual receives a reward from each player in the game but if wrong pays a penalty to the player with the game piece of the same color as landed upon;

wherein said game piece includes a start space on each of said arms adjacent said inner hub and wherein each of said start spaces includes a transfer position from the next adjacent arm as part of said start space and wherein each of said players places their colored game piece on the start piece of the same color at the beginning of the game;

each game board includes eight decks of question and answer cards spaces with different symbols for receiving a deck with backs of one distinguishing color between two radially extending arms near an outer portion of said areas; and a second set of question and answer cards and wherein a first of said sets include question and answers suitable for a first age group and said second set includes questions and answers appropriate for a second age group.

2. A board game consisting of the combination of:

a multi-colored game board of eight distinguishing colors with a white background having a central hub and eight radially extending arms disposed about said central hub and each of said radially extending arms including an outer end portion, a leading edge and a trailing edge wherein each of said radially extending arms include eight separate sequential colored spaces along said leading edge thereof and eight separate sequential colored spaces along said trailing edge thereof and abutting said eight colored spaces on said leading edge thereof and wherein said spaces on said leading edge include an indication of an inward direction toward said central hub and said spaces along said trailing edge include an indication of an outward direction and wherein said abutting spaces adjacent said central hub are of the same color; and each of said radially extending arms including a generally semicircular turnaround space at said outer end portion thereof extending across two abutting spaces and each of said turnaround spaces being one of said eight distinguishing colors and a transfer space extending from said central hub from a space on one arm and into a colored space on said trailing edge of an adjacent arm and of the same distinguishing color as the first space on said arm to thereby form a part of that said space;

eight colored game pieces whereas each of said game pieces is of one of said eight colors and distinguishable from each of the other game pieces;

a pair of dice and a quantity of play money;

eight decks of fifty question and answer cards and wherein each deck of cards includes cards wherein the back of said card are all one of said eight distinguishing colors that correspond to the eight colors of said game pieces and wherein the card categories include mathematics, history, geography, political science, current events, sports and the arts; and a thirty second timer and wherein each player starts with the game piece on a start space adjacent said central hub and rolls said dice and moves their game piece the number of spaces on said dice and wherein each player lands on a colored space, the player with a game piece picks a question and answer card from a deck of that color, ask the player on the colored space the question on the game card and starts the timer, the player on the colored space has 30 seconds to give the correct answer and if so receives a payment from each of the other players and if not pays a fine to the player who asked the question and when a player lands on a turnaround space that player gets three chances to roll double on the dice and if so collects a reward from a central fund;

the game ends when the next to the last player runs out of money;

which further consists of a second set of question and answer cards and wherein a first set of said question and answer cards are suitable for a first age group and a second set is suitable for a second age group and wherein said second set includes a separate design on the back of said cards that is distinguishable from a design on the backs of a first set.

3. A board game according to claim 2 wherein said game board includes symbols for receiving a second set of eight decks of question and answer cards.

* * * * *